US005961227A

United States Patent [19]

Kurachi

[11] Patent Number: 5,961,227

[45] Date of Patent: Oct. 5, 1999

[54] THERMAL RECORDING APPARATUS

[75] Inventor: Katsuhito Kurachi, Kasugai, Japan

[73] Assignee: Brother Kogyo Kabushiki Kaisha, Nagoya, Japan

[21] Appl. No.: 09/141,362

[22] Filed: Aug. 27, 1998

[30] Foreign Application Priority Data

Sep. 1, 1997 [JP] Japan ..... 9-236170

[51] Int. Cl.[6] ..... B41J 2/315

[52] U.S. Cl. ..... 400/120.09; 346/76; 346/1.1

[58] Field of Search ..... 346/76, 1.1; 400/120.09

[56] References Cited

U.S. PATENT DOCUMENTS

| | | | |
|---|---|---|---|
| 4,636,810 | 1/1987 | Asakura et al. | 346/76 |
| 4,806,949 | 2/1989 | Onuma et al. | 346/76 |
| 4,912,485 | 3/1990 | Minowa . | |
| 5,075,698 | 12/1991 | Aoki et al. | 346/1.1 |
| 5,079,564 | 1/1992 | Sasaki et al. | 346/76 |
| 5,109,235 | 4/1992 | Sasaki | 346/76 |
| 5,153,605 | 10/1992 | Ohara et al. . | |
| 5,188,469 | 2/1993 | Nagao et al. | 400/615.2 |
| 5,348,406 | 9/1994 | Yoshiaki et al. | 400/615.2 |
| 5,533,816 | 7/1996 | Ikeda et al. . | |
| 5,685,654 | 11/1997 | Nagao et al. | 400/615.2 |

FOREIGN PATENT DOCUMENTS

| | | | |
|---|---|---|---|
| 0 255 116 A2 | 2/1988 | European Pat. Off. . | |
| 0 600 593 A2 | 6/1994 | European Pat. Off. . | |
| 0 761 455 A1 | 3/1997 | European Pat. Off. . | |
| A-2-106555 | 4/1990 | Japan | 400/615.2 |
| A-7-156432 | 6/1995 | Japan | 400/615.2 |
| WO 90/03721 | 4/1990 | WIPO . | |
| WO 95/07821 | 3/1995 | WIPO . | |

*Primary Examiner*—Edgar Burr
*Assistant Examiner*—Charles H. Nolan, Jr.
*Attorney, Agent, or Firm*—Oliff & Berridge, PLC

[57] ABSTRACT

The number of pulses N corresponding to the gradation level of a print dot is read out from a table and stored in a counter 63 (S1). The first pulse is applied to the heating elements for the duration $T_1$ (S4) and is stopped for the duration $T_{off}$ (S6). The number of pulses N is read out and restored in the counter after the subtraction of 1 therefrom (S7). The second pulse is applied for the duration $T_2$ (S9) and then interrupted for the duration $T_{off}$ (S11). The number of pulses N is read out and, after 1 subtracted therefrom, is restored (S12). If the number of pulses N read out is not zero, the step for the application of pulses for the duration $T_2$ (S9) and subsequent steps are repeated. If the number of pulses N is zero, the application of pulses is terminated (S13).

7 Claims, 7 Drawing Sheets

70

| GRADATION LEVEL | 1 | 2 | 3 | 4 | 5 | 6 | 7 | 8 |
|---|---|---|---|---|---|---|---|---|
| THE NUMBER OF PULSES | 2 | 4 | 6 | 8 | 12 | 20 | 32 | 63 |

FIG.5

70

| GRADATION LEVEL | 1 | 2 | 3 | 4 | 5 | 6 | 7 | 8 |
|---|---|---|---|---|---|---|---|---|
| THE NUMBER OF PULSES | 2 | 4 | 6 | 8 | 12 | 20 | 32 | 63 |

THERMAL RECORDING APPARATUS

BACKGROUND OF THE INVENTION

1. Field of the Invention

The present invention relates to a thermal recording apparatus which performs recording pixels with a predetermined density by controlling the number of pulses of a pulse train to be selectively applied to a plurality of heating elements mounted on a thermal head.

More particularly, the invention relates to a thermal recording apparatus in which the first pulse with a larger width than those of the second and subsequent pulses causes heating elements to be preheated and the second pulse causes the same to record the pixel of the minimum density, thereby efficiently heating each of the heating elements, and enabling a high contrast thermal printing even by a small number of pulses.

Furthermore, the invention relates to a thermal recording apparatus which can easily obtain substantially the same density/gradation-level curve showing the change in density with respect to each gradation level as a density/dots-area curve.

2. Description of Related Art

There have been proposed various thermal recording apparatus using a thermal head for high gradation level recording.

For example, the thermal recording apparatus using the thermal halftone gradation level recording method disclosed in Japanese patent application laid-open No. 7-156432 uses a thermal head provided with a plurality of heating resistors arranged in a row in a main-scanning direction, each heating resistor having the smaller width in a sub-scanning direction than the width in the sub-scanning direction of one pixel. This apparatus records one pixel by heating the heating resistor by a pulse train having a number of pulses with the same width, modulating the recording width in the sub-scanning direction of the pixel. It records the recording pixel of the minimum density by initial several pulses of the pulse train, and records the pixels subsequent to the first pixel of the minimum density by successively increasing the number of pulses. Since a heating resistor recording one pixel is heated by a number of pulses each having the same width, the recording start position of one pixel can be selected freely. Also, the printing start position in the sub-scanning direction of a print dot recorded by each heating resistor is shifted within a printing width of one pixel so as to be different from adjacent pixels, so that the halftone gradation level recording can be performed without deterioration in image quality such as the generation of streak noise in the main-scanning direction.

However, since the thermal recording apparatus using the above thermal halftone gradation level recording method records the pixel of the minimum density by initial several pulses of a number of pulses, which heat intermittently the heating resistor (element), it takes a long time until the heating element is heated to a predetermined temperature and causes the deterioration in heating efficiency of the heating element. In the case of the apparatus having the maximum number of pulses is small, the maximum number of gradation levels is reduced since the initial pulses are used to preheat the heating resistor. It is also difficult to adjust the density/gradation-level curve of print image to correspond to the density/dots-area curve.

SUMMARY OF THE INVENTION

The present invention has been made in view of the above circumstances and has an object to overcome the above problems and to provide a thermal recording apparatus which can controls pulses to be applied to heating elements so that the width of a first pulse corresponds to the duration for which the heating elements are heated up to a substantial recording temperature and a second and subsequent pulses cause the heating elements to perform multilevel gradation recording, in order to shorten the preheating time of the heating elements thereby to enhance the heating efficiency.

Another object of the present invention is to provide a thermal recording apparatus which can records a pixel of the minimum density by the first and second pulses, whereby to perform multilevel gradation recording even if the maximum number of pulses of the apparatus is small, and also to easily provide a density/gradation-level curve substantially corresponding to a density/dots-area curve.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, there is provided a thermal recording apparatus including a thermal recording provided with a plurality of heating elements, pulse application means for selectively applying a drive pulse train to the heating elements, pulse number setting means for setting a number of pulses of the drive pulse train according to gradation density of a pixel to be printed through the heating elements, pulse width setting means for setting a width of a first drive pulse of the drive pulse train to be larger than those of a second and subsequent drive pulses, and pulse control means for applying the first drive pulse to the heating elements thereby to preheat the same up to a predetermined heating temperature and then the second and subsequent drive pulses to the preheated heating elements to record the pixel.

In the above thermal recording apparatus, the pulse number setting means sets the number of pulses according to the gradation density of a pixel to be printed, and the pulse apply means selectively applies the pulse train of the number of pulses to the heating elements mounted on the thermal recording device. The pulse width setting means sets in advance the widths of the pulses so that the width of the first pulse of the pulse train is larger than that of the second and subsequent pulses. The first pulse causes the heating elements to be preheated to the predetermined heating temperature. By the first and second pulses of the pulse train, the heating elements are heated to the predetermined temperature to record the pixel of the minimum density.

Accordingly, the heating elements are continuously energized by the first pulse of the pulse train to heat up to the predetermined temperature, so that the heating efficiency can be enhanced and the rising time up to the predetermined temperature can be shortened. Since the second and subsequent pulses have substantially the same width, the number of pulses with respect to each density level can be easily set. In addition, the first and second pulses of the pulse train can cause the pixel of the minimum density to be recorded. Even if the maximum number of pulses of the thermal recording apparatus is small, multi-level gradation recording can be achieved.

According to another aspect of the present invention, there is provided a thermal recording apparatus including a thermal recording device provided with a plurality of heating elements, pulse application means for selectively applying a drive pulse train to the heating elements by a number of drive pulses "m" which is larger than a number of gradation levels "n" which can be represented through the heating elements, and pulse number setting means for setting the number of drive pulses so as to be larger as the gradation density of a pixel to be printed through the heating element becomes higher, and setting an increasing rate of the number of pulses so as to be low in a low gradation density area and high in a high gradation density area.

Furthermore, according to another aspect of the present invention, there is provided a thermal recording apparatus including an input device for inputting character data such as characters and the like, a thermal head provided with a plurality of heating elements to print the characters and the like input by the input device on a long-sized tape, pulse application means for selectively applying a drive pulse train to the heating elements, pulse number setting means for setting a number of pulses of the drive pulse train according to gradation density of a pixel to be printed with the heating elements, pulse width setting means for setting a width of a first drive pulse of the drive pulse train to be longer than those of a second and subsequent drive pulses, and pulse control means for applying the first drive pulse to the heating elements thereby to preheat the same up to a predetermined preheating temperature and then the second and subsequent drive pulses to the heating elements to record the pixel.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 5 is a table listing the number of pulses of a pulse train corresponding to gradation level of a print dot in the embodiment;

DETAILED DESCRIPTION OF THE PREFERRED EMBODIMENTS

Figure 1:
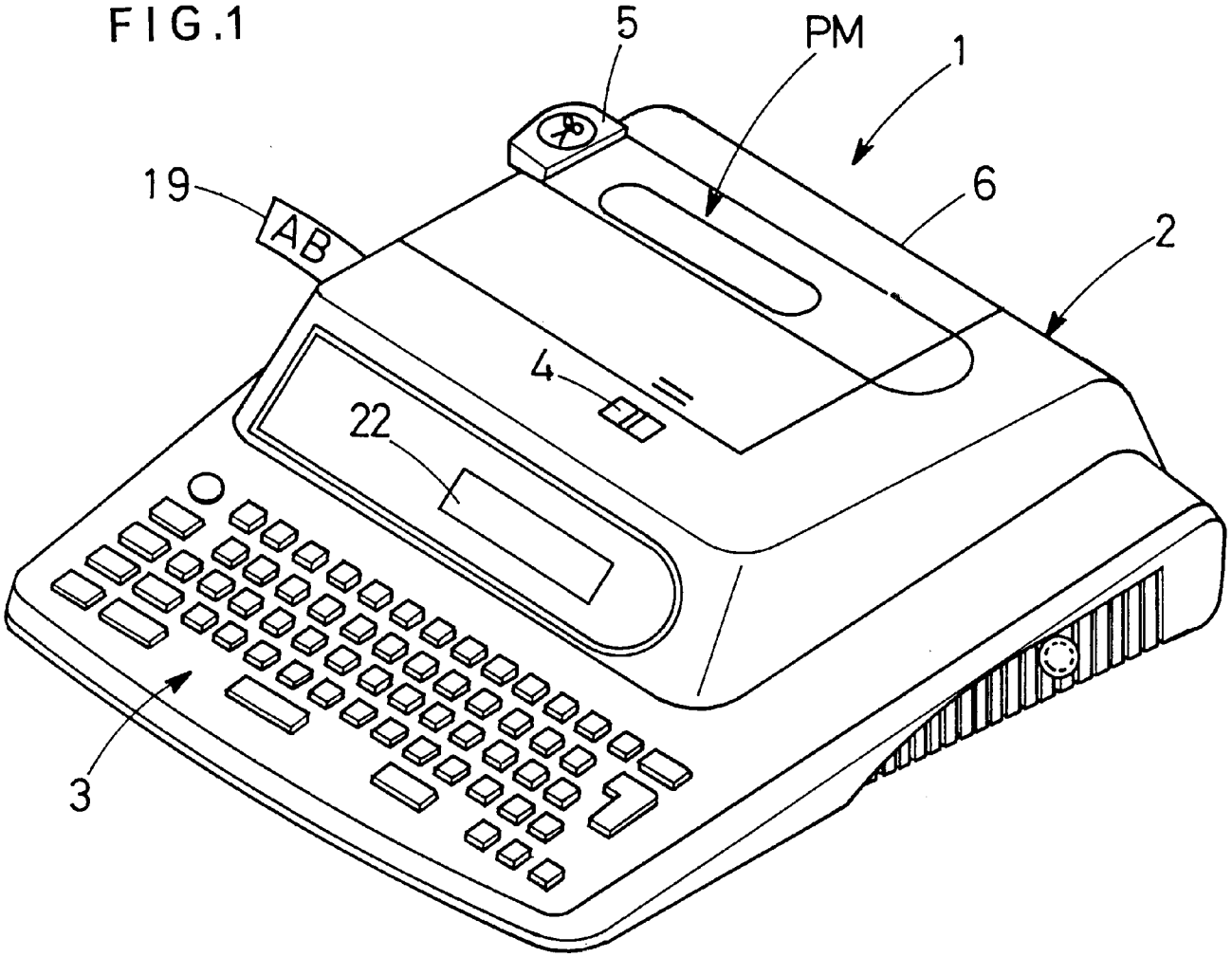
FIG. 1 is a perspective view of a tape printing apparatus in an embodiment according to the present invention.

A detailed description of one preferred embodiment of a tape printing device embodying a thermal recording apparatus of the present invention will now be given referring to the accompanying drawings. A schematic structure of the tape printing device in the embodiment is described with reference to FIGS. 1 and 2. FIG. 1 is a perspective view of the tape printing device and FIG. 2 is an enlarged view of a part of an internal structure of the tape printing device, i.e., a tape holding cassette thereof.

In FIG. 1, the tape printing device 1 is provided with a main frame 2, a keyboard 3 disposed on the front part of the main frame 2, a crystal liquid display (LCD) which can display characters and symbols, disposed at a right back of the keyboard 3, and a cover frame 6 constituting the upper portion of the main frame 2. On the upper surface of the main frame 2 is provided a release button 4 for opening the cover frame 6 when a tape holding cassette CS is attached to or detached from a printing mechanism PM of the tape printing device 1. A cutter button 5 which is pushed manually to cut a print tape 19 is provided at a side (a left side in FIG. 1) of the cover frame 6.

The keyboard 3 has various keys such as characteristic keys for the input of alphabets, numerals, and symbols, a space key, a return key, cursor-movement keys, a size setting key for arbitrarily setting the size of characters to be printed, six character-size keys for selecting the size from six dot sizes of 16, 24, 32, 48, 64, and 96, an automatic setting key for automatically setting the size of characters to be printed according to the width of the print tape 19 or the number of lines to be printed, a print start key for instructing printing, an execution key for terminating various setting operation, and a power key for turning on/off the device.

Figure 2:
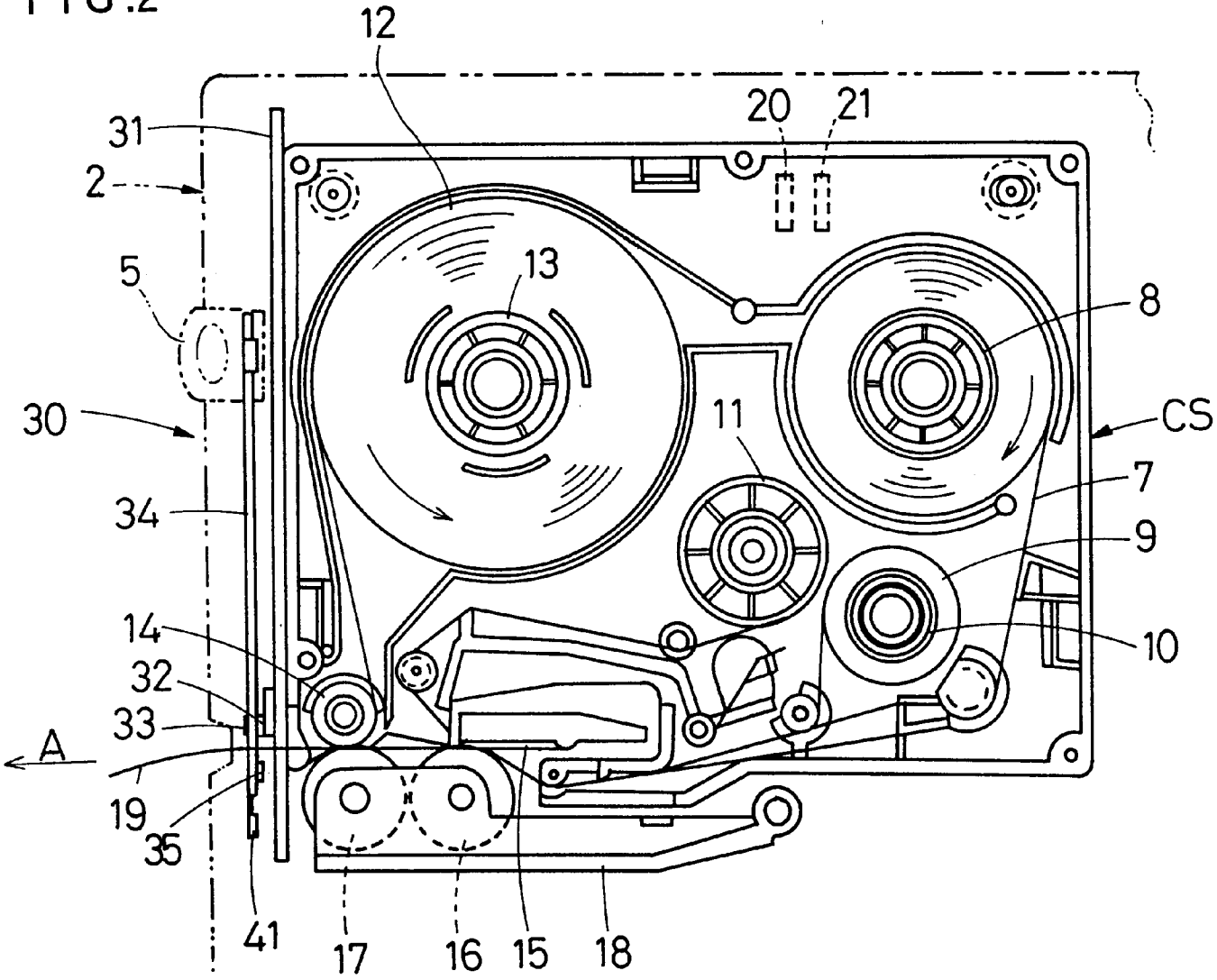
FIG. 2 is an enlarged sectional view of an inner structure of a tape holding cassette in the tape printing apparatus.

Next, the printing mechanism PM is explained, referring to FIG. 2. In the printing mechanism PM, the rectangular tape holding cassette CS is inserted detachably therefrom. This tape holding cassette CS is provided with a tape spool 8 on which transparent laminated film 7 is wound, an ink ribbon 9 constituted of a base film applied with ink which is melted when heated, a take-up spool 11 for taking up the ink ribbon 9, a supply spool 13 on which a double-sided adhesive tape 12 is wounded with its releasable sheet facing outside, the tape 12 having the same width as the laminated film 7, and a joint roller 14 for overlapping the double-sided adhesive tape 12 with the laminated film 7, all of those spools and rollers being rotatable. Note that the double-sided adhesive tape 12 consists of a base tape on both sides of which adhesive layers are applied and a releasable sheet attached on one of the adhesive layers.

A thermal head 15 is disposed extending upright at the position where the laminated film 7 and the ink ribbon 9 are overlapped. A platen roller 16 and a feed roller 17 are rotatably supported on a holder 18 that is pivotably attached in the main frame 2. The platen roller 16 presses the overlapped laminated film 7 and ink ribbon 9 against the thermal head 15. The feed roller 17 presses the laminated film 7 and the double-sided adhesive tape 12 against the joint roller 14 to form the print tape 19. The thermal head 15 is provided with a group of heating elements (not shown), for example, 128 heating elements in the embodiment, which are arranged in a line, i.e., in a vertical direction with respect to the drawing paper of FIG. 2.

With the above structure, the group of heating elements are energized while a tape feed motor 47 (see FIG. 3) is driven to rotate in a predetermined rotating direction, causing the joint roller 14 and the take-up spool 11 to rotate in synchronization with each other in a predetermined direction. The selected heating elements heat the ink ribbon 9 to melt the ink applied on the ink ribbon 9. The melted ink is transferred on the laminated film 7. As a result thereof, characters and bar codes consisting of a plurality of dots are printed on the laminated film 7, which is overlapped with the double-sided adhesive tape 12, forming the printed tape 19. This printed tape 19 is fed in a tape feed direction indicated by an arrow A in FIG. 2, i.e., to the outside of the main frame 2 as shown in FIGS. 1 and 2. Note that for the detail structure of the printing mechanism PM, see the publication of Japanese Patent application laid-open No. 2-106555.

Next, a manual-type cutter 30 for cutting the printed tape 19 is described with reference to FIG. 2. A plate-like ancillary frame 31 is provided extending upright in the frame 2. A fixing blade 32 is secured upward to the ancillary frame 31. An operation lever 34 extending in an up-and-down direction in FIG. 2 is supported on an axis 33 fixed to the ancillary frame 31 so that a portion near a front (lower in the drawing) end of the lever 34 be rotatable about the axis 33. A further front portion of the lever 34 than the position of the axis 33 is attached with a movable blade 35 opposite to the fixing blade 32.

The lever 34, a rear end portion of which is positioned under the cutter button 5, is always biased by the spring force of a spring member not shown in the direction so that the movable blade 35 is separated from the fixing blade 32. On a front end of the lever 34, attached is a switch 41 for detecting that the lever 34 has been rotated by the depression of the cutter button 5 to cut the printed tape 19.

After printing, the printed tape 19 is fed through the gap between the fixing blade 32 and the movable blade 35 to the outside of the main frame 2. Upon depression of the cutter button 5, the lever 34 is rotated with movable blade 35 toward the fixing blade 32, so that the blades 32 and 35 cut the printed tape 19 therebetween.

Meanwhile, the control system of the tape printing apparatus 1 in the embodiment will be explained with reference to a block diagram of FIG. 3.

Figure 3:
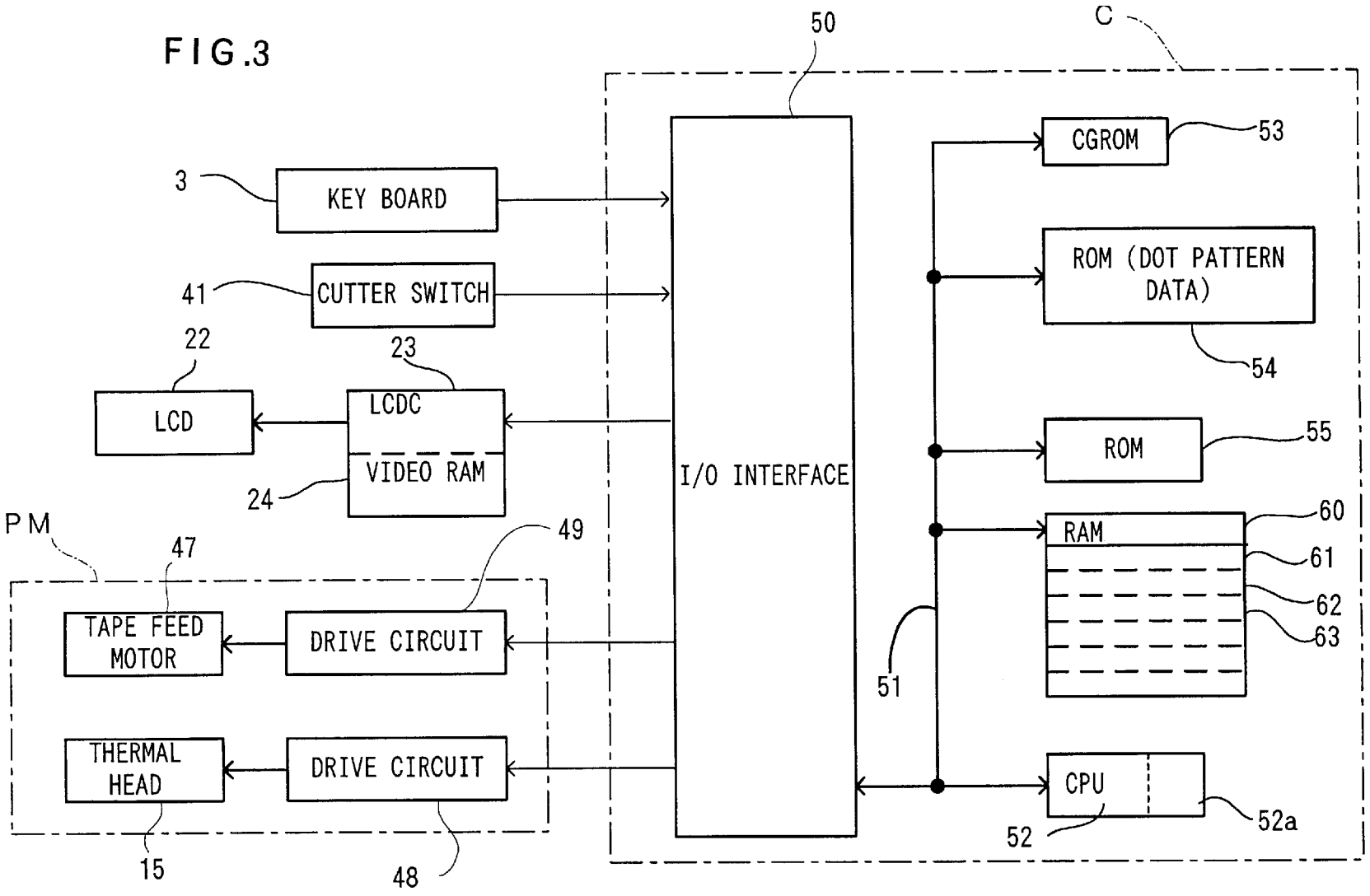
FIG. 3 is a block diagram showing the control system of the tape printing apparatus.

In FIG. 3, the controller C has a CPU 52 for controlling each component of the tape printing apparatus 1. The controller C further has an input/output interface 50, a CGROM 53, ROMs 54 and 55, and a RAM 60, which are connected to the CPU 52 through a data bus 51. The CPU 52 is internally provided with a timer 52*a*. To the I/O interface 50 are connected the keyboard 3, the switch 41, a display controller (LCDC) 23 having a video RAM 24 for outputting display data on the LCD 22, a driver circuit 48 for driving the thermal head 15, and a driver circuit 49 for driving the tape feed motor 47.

The CGROM 53 stores dot patterns data corresponding to a number of characters to be displayed, in the form of code data.

The ROM 54 serving as a dot pattern data memory stores print dot pattern data, in the form of code data, corresponding to a number of characters such as alphabets, symbols, and the like to be printed. The print dot pattern data are classified by fonts (Gothic type font, Ming type font, etc.) and further six sizes (16, 24, 32, 48, 64, and 96 dot sizes) per each font type. The ROM 54 also stores graphic pattern data for printing graphic image with gradation level.

The ROM 55 stores a display drive control program for controlling the LCDC 23 in response to the code data corresponding to characters, numerals, etc. which are input with the keyboard 3, a print drive control program for driving the thermal head 15 and the tape feed motor 47 by reading out the data from a print buffer 62, a table 70 (see FIG. 5) of the number of pulses in a pulse train in correspondence with each gradation level, and a gradation level control program which will be mentioned later.

The ROM 60 has a text memory 61, the print buffer 62, and a counter 63, and others. The text memory 61 stores text data input from the keyboard 3. The print buffer 62 stores print dot pattern, or print data, which corresponds to a plurality of characters, numerals, and others. The counter 63 stores a count value N which is to be counted in correspondence with the heating elements in the gradation level control process.

Figure 4:
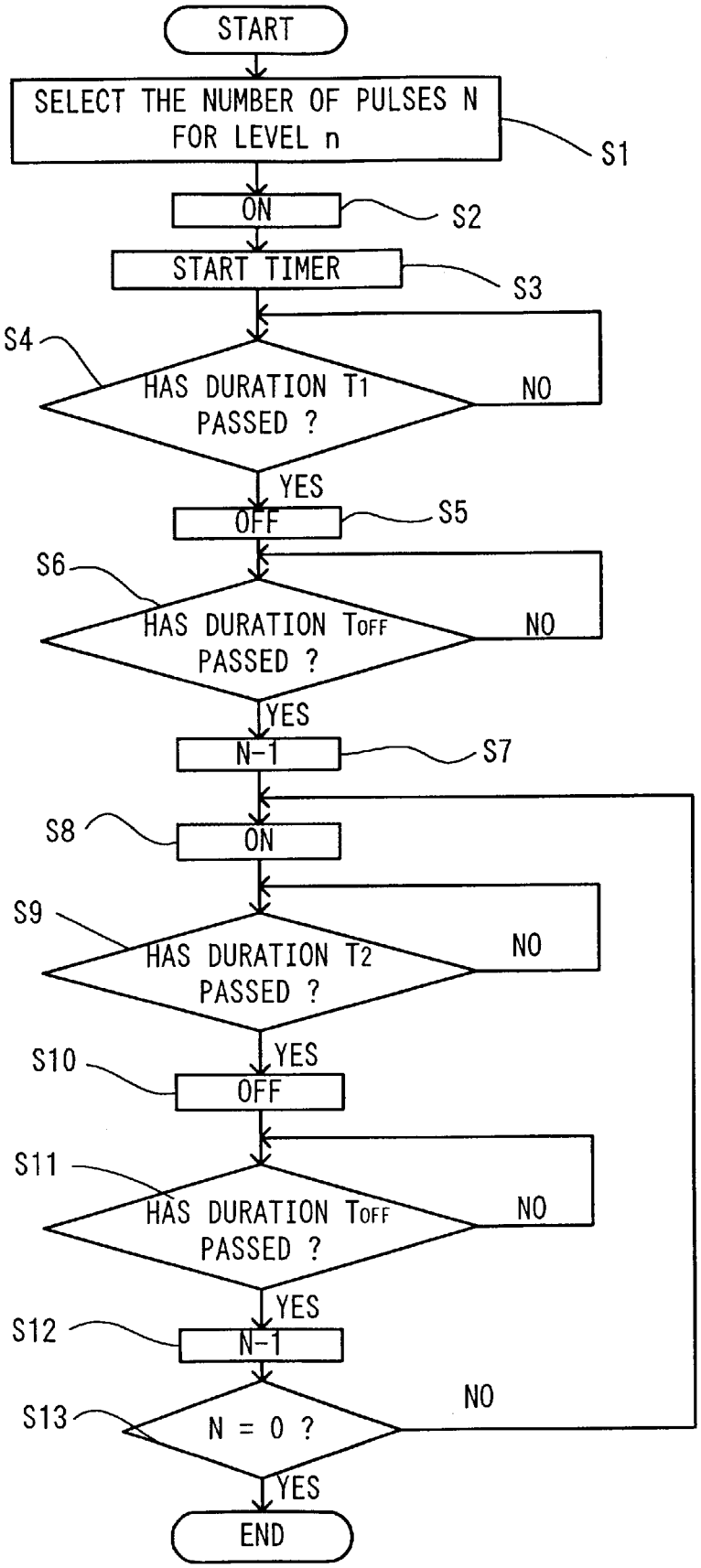
FIG. 4 is a flowchart of a control operation of a gradation level, executed by a controller C in the tape printing apparatus.
Figure 6:
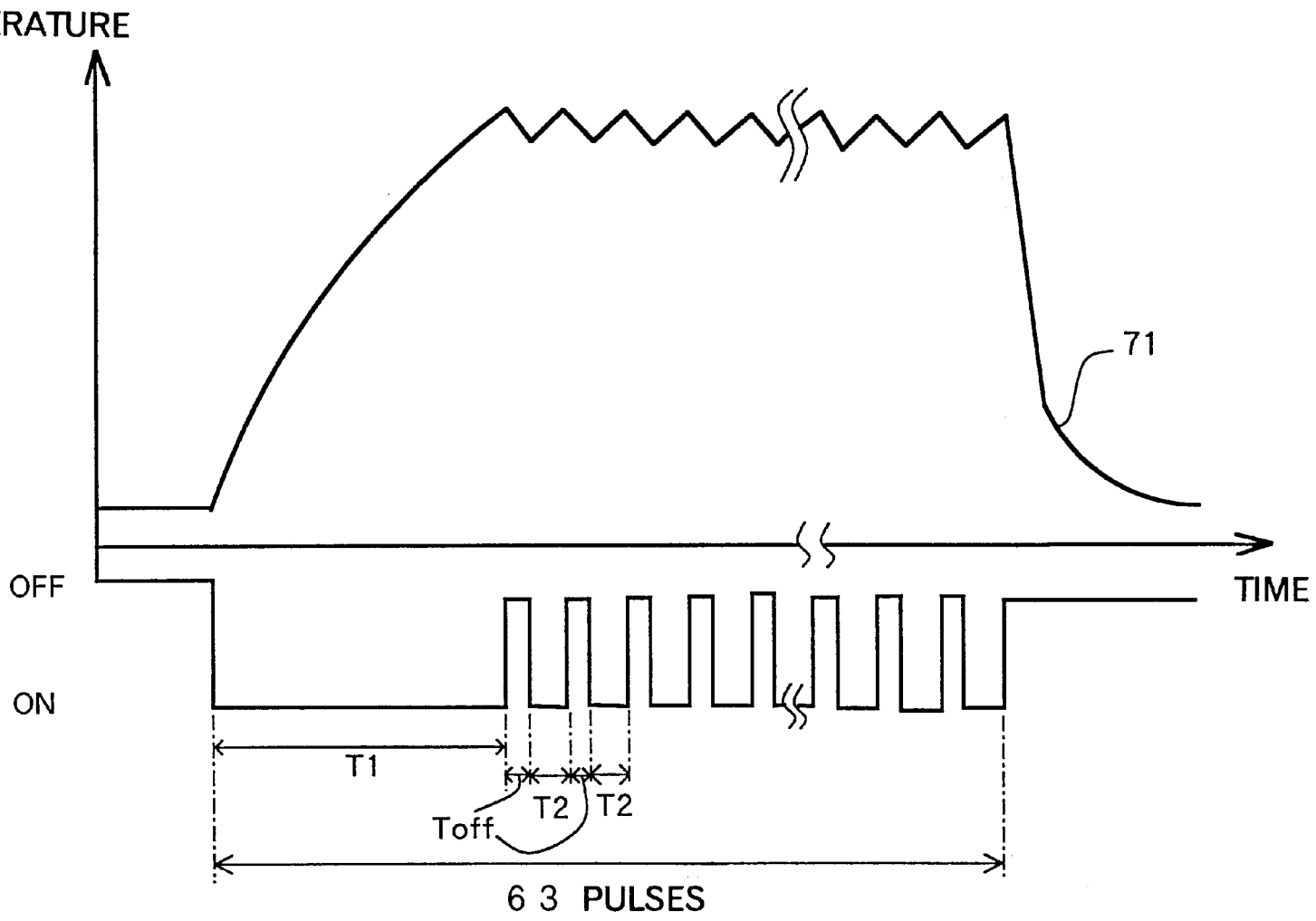
FIG. 6 is a time-chart of the gradation level control wherein 63 pulses are applied to heating elements.
Figure 7:
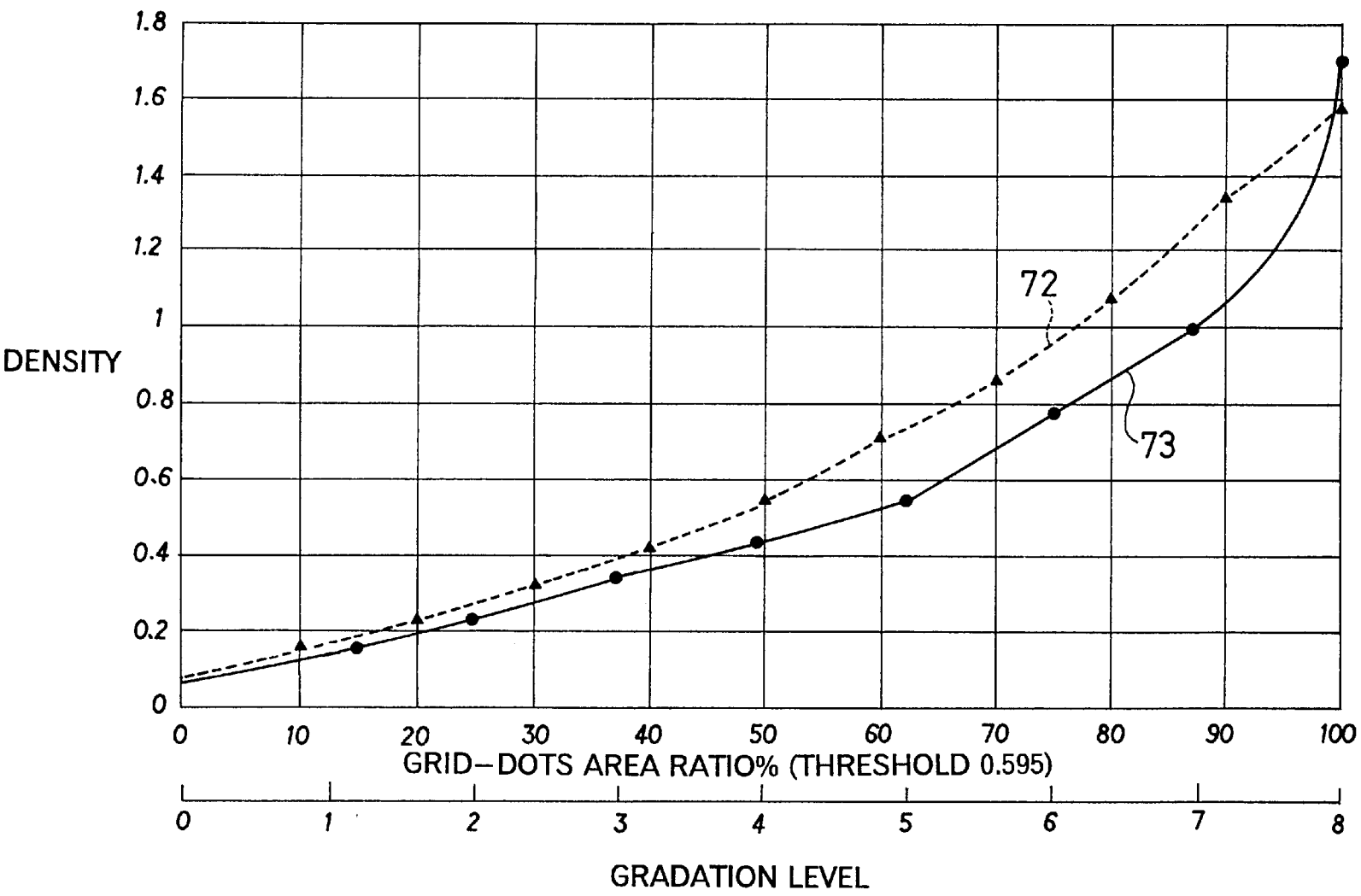
FIG. 7 is a graph showing the relation of the gradation levels and the dots-area ratio with the density.

Next, the gradation level control process executed in the tape printing apparatus 1 will be described with reference to FIGS. 4 to 7. FIG. 4 is a flowchart of the gradation level control process executed in the controller C of the apparatus 1. FIG. 5 is a table listing the number of pulses in a pulse train for the gradation level of the print dot in the embodiment. FIG. 6 is a time chart of the gradation level control process in which 63 pulses are applied. FIG. 7 is a graph showing the relation of the gradation levels and the dots-area ratio with the density.

When a text including a graphic image with gradation level is prepared by the operation of character keys on the keyboard 3, the data of the text is stored in the text memory 61. When the print start key on the keyboard 3 is depressed, providing a print start command, the print data is produced based on the text data stored in the text memory 61 and the print dot pattern data and the graphic pattern data stored in the ROM 54, and the produced print data is stored in the print buffer 62. The CPU 52 starts the gradation level control process to apply pulses to each of the selected heating elements of the thermal head 15 in accordance with the print data.

In the gradation level control process, the number of pulses corresponding to the gradation level of a print dot of each heating element is read out from the table 70 (see FIG. 5) stored in the ROM 55. The number of pulses N with respect to each heating element is stored in the counter 63(S1).

Here, the table 70 is explained with reference to FIG. 5. The tape printing device 1 in the present embodiment has 8 gradation level settings. The number of pulses N corresponding to each gradation level is determined at 2 pulses for the gradation level 1, 4 pulses for the gradation level 2, 6 pulses for the gradation level 3, 8 pulses for the gradation level 4, 12 pulses for the gradation level 5, 20 pulses for the gradation level 6, 32 pulses for the gradation level 7, and 63 pulses for the gradation level 8.

In the table 70, accordingly, the increasing rate of pulses is set so as to be small in the low gradation level and large in the high gradation level.

Subsequently, when the CPU 52 starts the application of pulses to each of the selected heating elements of the thermal head 15 to start the heating of the heating elements (S2).

The CPU 52 operates the timer 52*a* to start (S3), and reads the ON-duration $T_1$ of the first pulse from the ROM 55 and waits until the count time of the timer 52*a* reaches the ON-duration $T_1$ (S4: NO). When the ON-duration $T_1$ has passed (S4: YES), the CPU 52 interrupts the application of pulses to the selected heating elements, and stops the timer 52*a* to reset the count time to 0 and starts the timer 52*a* again (S5).

Next, the CPU 52 reads the OFF-duration $T_{off}$ of the pulses from the ROM 55 and waits until the timer 52*a* counts the OFF-duration $T_{off}$ (S6: NO). When the OFF-duration $T_{off}$ has passed (S6: YES), the timer 52*a* is stopped to reset the count time to 0 and then restarted.

Next, the CPU 52 reads the number of pulses N corresponding to each of the selected heating elements from the counter 63, subtracts 1 from the number N, and restores the calculated number per the heating element in the counter 63 (S7). Sequentially, the CPU 52 makes the application of pulses to each of the selected heating elements of the thermal head 15 (S8).

The CPU 52 reads the second ON-duration $T_2$ of the application of the second and subsequent pulses and waits until the count time of the timer 52*a* reaches $T_2$ (S9: NO). After a lapse of the ON-duration $T_2$ (S9: YES), the application of pulses to each of the selected heating elements is turned OFF, and the timer 52*a* is stopped to set the count time to 0 and is restarted (S10).

Here, the ON-duration $T_2$ of the second and subsequent pulses is set shorter than the ON-duration $T_1$ of the first pulse.

Next, the CPU 52 reads the OFF-duration $T_{off}$ of pulses from the ROM 55 and waits until the timer 52*a* counts the OFF-duration $T_{off}$ (S11: NO). After a lapse of the OFF-duration $T_{off}$ (S11: YES), the CPU 52 stops the timer 52*a* to reset the count time to 0 and restart the timer 52*a*.

The CPU 52 reads the number of pulses N corresponding to each of the selected heating elements from the counter 63, subtracts 1 from the number N, and restores the calculated number per heating element in the counter 63 (S12).

The CPU 52 reads the number of pulses N from the counter 63 and, if the number N is not 0 (S13: NO), makes the application of pulses to the selected heating elements (S8). These steps from S8 are repeated until the number of pulses N reaches 0.

When the number of pulses N is 0 (S13: YES), the application of pulses to the selected heating elements is terminated.

Next, an example of a change in temperature of a heating element in the above gradation level control process will be explained, referring to FIG. 6. FIG. 6 is a graph showing the temperature-rise of the heating element relative to the time when the number of pulses N to be applied to the heating element is 63.

The first pulse is applied for the duration $T_1$. The increasing temperature curve 71 of the heating element substantially comes up to the intended heating temperature. The application of pulses is turned off for the duration $T_{off}$, causing a small decrease in temperature. The temperature increases again upon the application of the second pulse for the duration $T_2$. The interruption of pulse application for the duration $T_{off}$ and the execution of pulse application for the duration $T_2$ are repeated until the number of pulses N stored in the counter 63 becomes 0.

The heating element is preheated by the first applied pulse to a predetermined temperature and then maintained at an almost constant temperature for the duration defined by $(T_2 \times 62 + T_{off} \times 62)$ by the second through sixty-third applied pulses, so that the dot of the gradation level 8 is printed on the laminated film 7. Similarly, the dot of the gradation level 1 is printed by the pulse train of 2 pulses. The dot of the level 2 is printed by the pulse train of 4 pulses. The dot of the level 3 is printed by the pulse train of 6 pulses. The dot of the level 4 is printed by the pulse train of 8 pulses. The dot of the level 5 is printed by the pulse train of 12 pulses. The dot of the level 6 is printed by the pulse train of 20 pulses. And the dot of the level 7 is printed by the pulse train of 32 pulses.

Next, explanation is made on an example of the relationship of the density with the gradation level and the ratio of area of dots forming a grid pattern when the controller C of the tape printing apparatus 1 in the embodiment performs the gradation level control process to print dots, referring to FIG. 7.

It is to be noted that a dot is the minimum unit of the area of ink adhered on a recording medium or the like, variation of the size (area) of the dots causes the gradation level to be represented. The density with respect to each ratio of the dots-area of ink is measured by a densitometer, with 0.595 of the threshold of the ink dots-area in the present embodiment. As a result of the measurement, the relationship between the density and each of the dots-area ratios varies as shown by a density/dots-area curve 72 in FIG. 7.

Specifically, the following results are obtained: the density is 0.15 for 10% of dots-area ratio, 0.23 for 20% of the ratio, 0.31 for 30% of the ratio, 0.41 for 40% of the ratio, 0.55 for 50% of the ration, 0.71 for 60% of the ratio, 0.86 for 70% of the ratio, 1.08 for 80% of the ratio, 1.35 for 90% of the ratio, 1.58for 100% of the ratio.

As mentioned above, the number of pulses to be applied to the thermal head is determined for each gradation level so that the density with respect to each gradation level agrees with the above density with respect to each dots-area ratio. In the present embodiment, the number of pulses in the table 70 of FIG. 5 is set.

In the present embodiment, the following results are obtained: the density is 0.15 for the gradation level 1, 0.22 for the level 2, 0.34 for the level 3, 0.44 for the level 4, 0.54 for the level 5, 0.78 for the level 6, 1.0 for the level 7, and 1.7 for the level 8. Accordingly, the relationship between the density and each gradation level varies as shown by the density/gradation-level curve 73 of FIG. 7.

In this way, the density/gradation-level curve 73 showing the relationship between the print density and each gradation level substantially agrees with the density/dots-area curve 72 showing the relationship between the print density and the dots-area ratio. In other words, if the number of pulses for each of the gradation levels is set based on the table 70, the density/gradation-level curve 73 becomes almost the same as the density/dots-area curve 72.

As described above in detail, in the tape printing apparatus 1 in the present embodiment, under the control of the controller C, the width (application duration) of the first pulse of the pulse train to be applied to each heating element of the thermal head 15 is set at $T_1$, thereby to preheat the heating element to a predetermined heating temperature. The application of pulses is then turned off for the duration $T_{off}$. The width of the second pulse of the pulse train is set at the duration $T_2$. The execution of pulse application for the duration $T_2$ and the interruption for the duration $T_{off}$ are alternately made until the predetermined number of pulses are applied to the heating element thereby to print the dot with a predetermined level of gradation density.

Accordingly, since the heating element is continuously energized until heated to a predetermined temperature by the first pulse of the pulse train, the heating efficiency can be enhanced and the temperature rise time of the heating element to the predetermined heating temperature can be shortened. Since the second and subsequent pulses have substantially the same width, the number of pulses to be applied per each density level can be easily set. The first and second pulses of the pulse train can cause the heating element to record the pixel of the minimum density, so that the tape printing apparatus 1 only having the maximum number of pulses that is relatively small can perform multilevel recording.

The record density exponentially increases as the increase of the number of pulses to be applied to each heating element. If the number of pulses in the low density level (i.e., levels 1 to 4 in the embodiment) is increased by two pulses per level, the number of pulses in the medium density level (i.e., levels 5 to 7 in the embodiment) is increased by 4, 8, and 12 pulses respectively, and the number of pulses in the high density level is increased by 32 pulses, the density/gradation-level curve 73 can easily be made correspondent with the density/dots-area curve 72. Such the setting of the number of pulses of the pulse train can provide the density/gradation-level curve 73 so as to be coincident with the density/dots-area curve 72. As a result, the thermal recording even in the low density level can provide a clear change in density of print images, resulting in the thermal recording which produces print images easy to recognize for human eyes.

The present invention may be embodied in other specific forms without departing from the spirit or essential characteristics thereof.

(a) For instance, although the number of pulses according to the gradation level is set in accordance with the table 70 in the above embodiment, each of the number of pulses in the table 70 may be changed in correspondence with the kinds of ink and others.

(b) Although 8 gradation levels are used in the above embodiment, more than 8 levels may be set.

(c) Although the maximum number of pulses in level 8 is set at 63 pulses in the above embodiment, it may be set at more than 63 if the application duration $T_1$ is lengthened and the ON-duration $T_2$ and the OFF-duration $T_{off}$ are shortened.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A thermal recording apparatus, including:

a thermal recording device provided with a plurality of heating elements, the thermal recording device capable of printing a pixel with a number of gradation levels "n";

pulse application means for selectively applying a drive pulse train to the heating elements, the pulse application means capable of applying a number of drive pulses "m" that is larger than the number of gradation levels "n" to the heating elements;

pulse number setting means for setting a number of pulses of the drive pulse train according to gradation density of the pixel to be printed through the heating elements;

pulse width setting means for setting a width of a first drive pulse of the drive pulse train to be larger than those of a second and subsequent drive pulses; and pulse control means for applying the first drive pulse to the heating elements thereby to preheat the same up to a predetermined heating temperature and then the second and subsequent drive pulses to the preheated heating elements to record the pixel.

2. A thermal recording apparatus according to claim 1, wherein the pulse number setting means sets the number of the second and subsequent drive pulses of the drive pulse train so as to be larger as the gradation density of a pixel becomes higher, and sets an increasing rate of the number of pulses so as to be low in a low gradation density area and high in a high gradation density area.

3. A thermal recording apparatus according to claim 1, further including:

a first storage device for storing the number of pulses in correspondence with each of a plurality of gradation density levels of a pixel to be printed through the heating elements;

a read-out device for reading out the number of drive pulses corresponding to the gradation density level from the first storage device;

a second storage device for storing the number of pulses read out by the read-out device;

subtract means for subtracting 1 each from the number of drive pulses stored in the second storage device whenever the pulse application means applies the drive pulses to the heating element; and judgement means for judging whether or not a value obtained by the subtraction by the subtraction means is 0;

wherein the pulse application means applies the drive pulses to the heating element until the judgement means judges that the subtracted value becomes 0.

4. A thermal recording apparatus, including:

a thermal recording device provided with a plurality of heating elements, the thermal recording device capable of printing a pixel with a number of gradation levels "n";

pulse application means for selectively applying a drive pulse train to the heating element, the pulse application means capable of applying a number of drive pulses "m" that is larger than the number of gradation levels "n" to the heating elements; and pulse number setting means for setting the number of drive pulses so as to be larger as the gradation density of a pixel to be printed through the heating elements becomes higher, and setting an increasing rate of the number of pulses so as to be low in a low gradation density area and high in a high gradation density area.

5. A thermal recording apparatus, including:

an input device for inputting character data such as characters;

a thermal head provided with a plurality of heating elements to print the characters input by the input device on a long-sized tape, the thermal recording device capable of printing a pixel with a number of gradation levels "n";

pulse application means for selectively applying a drive pulse train to the heating elements, the pulse application means capable of applying a number of drive pulses "m" that is larger than the number of gradation levels "n" to the heating elements;

pulse number setting means for setting a number of pulses of the drive pulse train according to gradation density of a pixel to be printed with the heating elements;

pulse width setting means for setting a width of a first drive pulse of the drive pulse train to be longer than those of a second and subsequent drive pulses; and pulse control means for applying the first drive pulse to the heating elements thereby to preheat the same up to a predetermined preheating temperature and then the second and subsequent drive pulses to the heating elements to record the pixel.

6. A thermal recording apparatus according to claim 1, wherein each of the second and subsequent drive pulses has a same width.

7. A thermal recording apparatus according to claim 5, wherein each of the second and subsequent drive pulses has a same width.

* * * * *